US008403330B2

(12) United States Patent
Cho

(10) Patent No.: US 8,403,330 B2
(45) Date of Patent: Mar. 26, 2013

(54) BALL NET OF BOX TYPE WITH RAISED FRONT TOP

(76) Inventor: Kwang Han Cho, Northridge, CA (US)

( * ) Notice: Subject to any disclaimer, the term of this patent is extended or adjusted under 35 U.S.C. 154(b) by 134 days.

(21) Appl. No.: 12/900,112

(22) Filed: Oct. 7, 2010

(65) Prior Publication Data

US 2012/0088593 A1 Apr. 12, 2012

(51) Int. Cl.
*A63B 63/00* (2006.01)

(52) U.S. Cl. ..... 273/400; 473/197; 473/478

(58) Field of Classification Search ..... 473/476, 473/478, 197, 434, 435, 454, 456; 273/398–402, 273/395, 396

See application file for complete search history.

(56) References Cited

U.S. PATENT DOCUMENTS 2,922,653 A * 1/1960 O'Brien ..... 473/197
3,501,150 A * 3/1970 Frischman ..... 473/478
5,722,446 A * 3/1998 Zheng ..... 135/125
6,517,444 B1 * 2/2003 Yoon ..... 473/197
6,607,455 B1 * 8/2003 Petras ..... 473/478
6,793,594 B1 * 9/2004 Grant ..... 473/476
6,793,595 B1 * 9/2004 Monnet ..... 473/478
6,966,852 B2 * 11/2005 Yoon ..... 473/421
7,651,098 B2 * 1/2010 Cho ..... 273/400
2003/0203775 A1 * 10/2003 Wong ..... 473/478

* cited by examiner

*Primary Examiner* — Mark Graham
(74) *Attorney, Agent, or Firm* — John K. Park; Park Law Firm

(57) ABSTRACT

A ball net of box type comprises a front loop, a rear loop, and first and second side loops. The enclosing net portion are for covering a top hole formed by top portions of the loops, two side holes formed by the side loops, and a rear hole formed by the rear loop, so as to enclose the box-type space from four sides. The vertical side straight portions of neighboring loops are hold together by fabric holder portions. The top curved portion of the front loop protrudes above the top straight portions of the other loops, such that a front opening defined by the front loop provides a receiving area larger than the other holes defined by the other loops especially in a upper portion of the receiving area. The front loop has a larger area than the other loops in a lower portion of the receiving area.

17 Claims, 6 Drawing Sheets

BALL NET OF BOX TYPE WITH RAISED FRONT TOP

BACKGROUND OF THE INVENTION

The present invention relates to a practice net for use in various sports such as baseball, golf, etc. More specifically, the present invention relates to a ball net of box type with raised front top designed to capture balls within its enclosure for easy retrieval.

Practice nets are generally used to contain moving balls in order to eliminate the need to retrieve the balls.

SUMMARY OF THE INVENTION

The present invention aims to provide a portable, lightweight, and easy to use exercise platform by which users can practice various sports activities.

The present invention provides a ball net of box type with raised front top.

The ball net of box type comprises a front loop, a rear loop, and first and second side loops.

The front loop comprises a top curved portion, two side straight portions, a bottom straight portion, and two lower corner portions.

The rear loop comprises four straight portions and four corner portions, and the rear loop is disposed such that a plane defined by the rear loop is parallel to a plane defined by the front loop.

The first side loop comprises four straight portions and four corner portions. A side one of the four straight portions engages foldably one of the two side straight portions of the front loop, and another side one of the four straight portions engages foldably one of the four straight portions of the rear loop.

The second side loop comprises four straight portions and four corner portions. A side one of the four straight portions engages foldably one of the two side straight portions of the front loop, and another side one of the four straight portions engages foldably one of the four straight portions of the rear loop, such that the front loop, the rear loop, the first side loop, and the second side loop form a box-type space in the middle.

The plurality of triangular holders are for holding two straight portions having a corner portion inbetween so as to form a substantially right angle between the two straight portions.

The enclosing net portion are for covering a top hole formed by top portions of the loops, two side holes formed by the side loops, and a rear hole formed by the rear loop, so as to enclose the box-type space from four sides.

The vertical side straight portions of neighboring loops are hold together by fabric holder portions.

The top curved portion of the front loop protrudes above the top straight portions of the other loops, such that a front opening defined by the front loop provides a receiving area larger than the other holes defined by the other loops especially in a upper portion of the receiving area.

The front loop has a larger area than the other loops in a lower portion of the receiving area.

A width of top portion of the front loop may be smaller than a width of bottom portion of the front loop.

The ball net may further comprise a tilted bottom net portion having a front edge portion, two side edge portions, and a rear edge portion. The front edge portion may engage the bottom straight portion of the front loop. The rear edge portion may engage the enclosing net portion for covering the rear hole formed by the rear loop along a line which is horizontal to the straight portion at a bottom and elevated by a predetermined height. One of the two side edge portions may engage the enclosing net portion for covering the side hole, and the other one of the two side edge portions detachably may engage the enclosing net portion for covering the other side hole.

A corner of the front edge portion of the tilted bottom net portion may be fixed to a corner portion extending from the bottom straight portion of the front loop.

The corner portion may be curved.

The rear edge portion of the tilted bottom net portion may be fixed to the enclosing net portion covering the rear hole.

The rear edge portion of the tilted bottom net portion may be attached to the enclosing net portion covering the rear hole by sewing or seaming together.

One of the two side edge portion of the tilted bottom net portion may be fixed to the enclosing net portion covering the side hole corresponding to the side edge portion.

One of the two side edge portion of the tilted bottom net portion may be detachably attached to the enclosing net portion covering the side hole corresponding to the side edge portion by one or more fasteners.

The one or more fasteners may comprise a plurality of loop and hook fasteners, a plurality of hanging hooks, and a plurality of clips.

A corner of the front edge portion of the tilted bottom net portion may be fixed to a lower part of the side straight portion of the front loop.

The corners of the rear edge portion of the tilted bottom net portion detachably may engage vertical straight portions of the rear loop.

A plurality of portions of the rear edge portion may be fixed to the enclosing net portion by a plurality of fasteners.

One or more fasteners may comprise a plurality of loop and hook fasteners.

The fabric holder portions may be integrated with the enclosing net portion.

The enclosing net portion may engage the front loop, the rear loop, and first and second loops.

The loops may be disposed through holes provided in the enclosing net portion.

A ball returning tent-net makes it convenient for practicing various sports activities because it is light, easy to assemble, and does not take a lot of space. The ball net provides a structure for a larger catching area.

Although the present invention is briefly summarized, the fuller understanding of the invention can be obtained by the following drawings, detailed description and appended claims.

BRIEF DESCRIPTION OF THE DRAWINGS

These and other features, aspects and advantages of the present invention will become better understood with reference to the accompanying drawings, wherein.

DETAILED DESCRIPTION OF THE INVENTION

Figure 1:
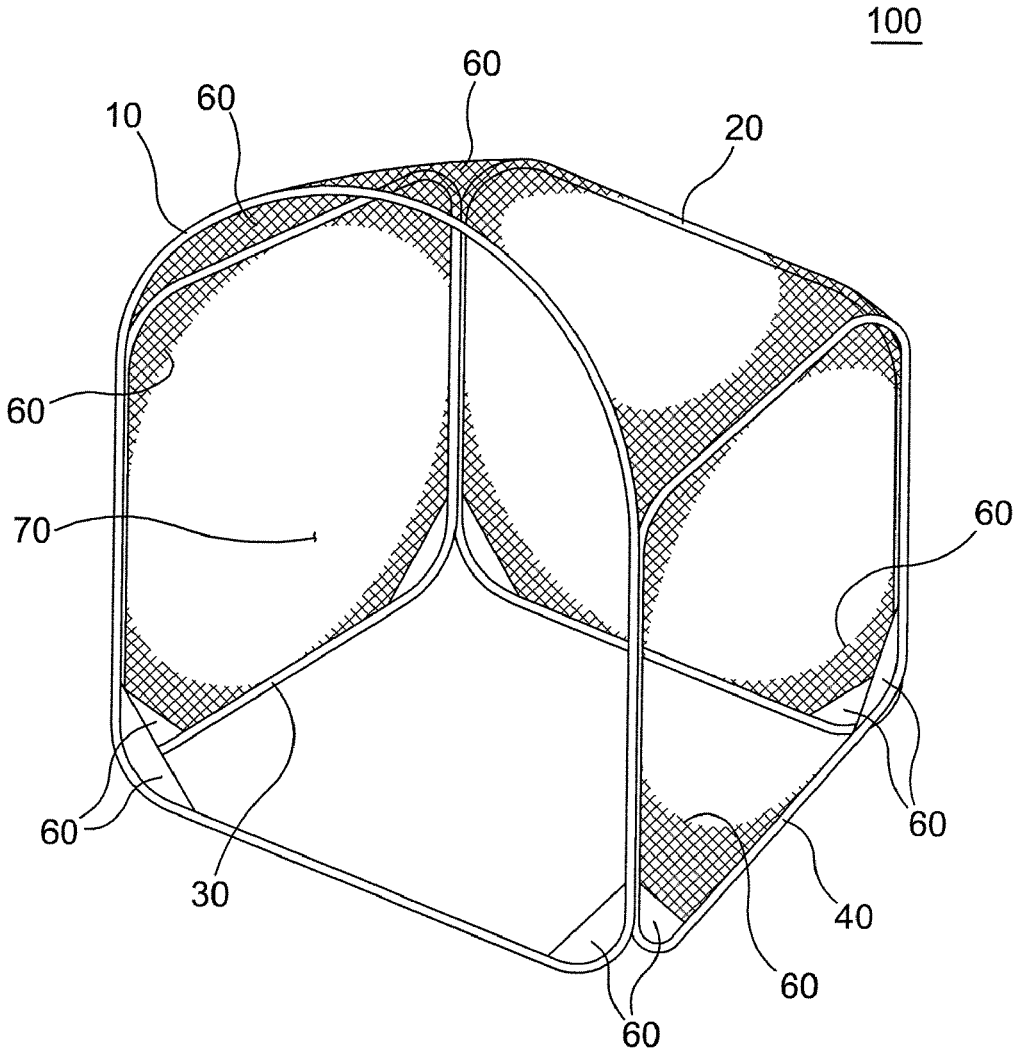
FIG. 1 is a perspective view of a ball net according to an embodiment of the invention.

FIGS. 1-4 show a ball net 100 according to an embodiment of the invention.

FIGS. 5-8 show elements of the ball net 100 titled bottom net portion.

The ball net 100 of box type comprises a front loop 10, a rear loop 20, first and second side loops 30, 40, a plurality of triangular holders 50, and an enclosing net portion 60.

Figure 2:
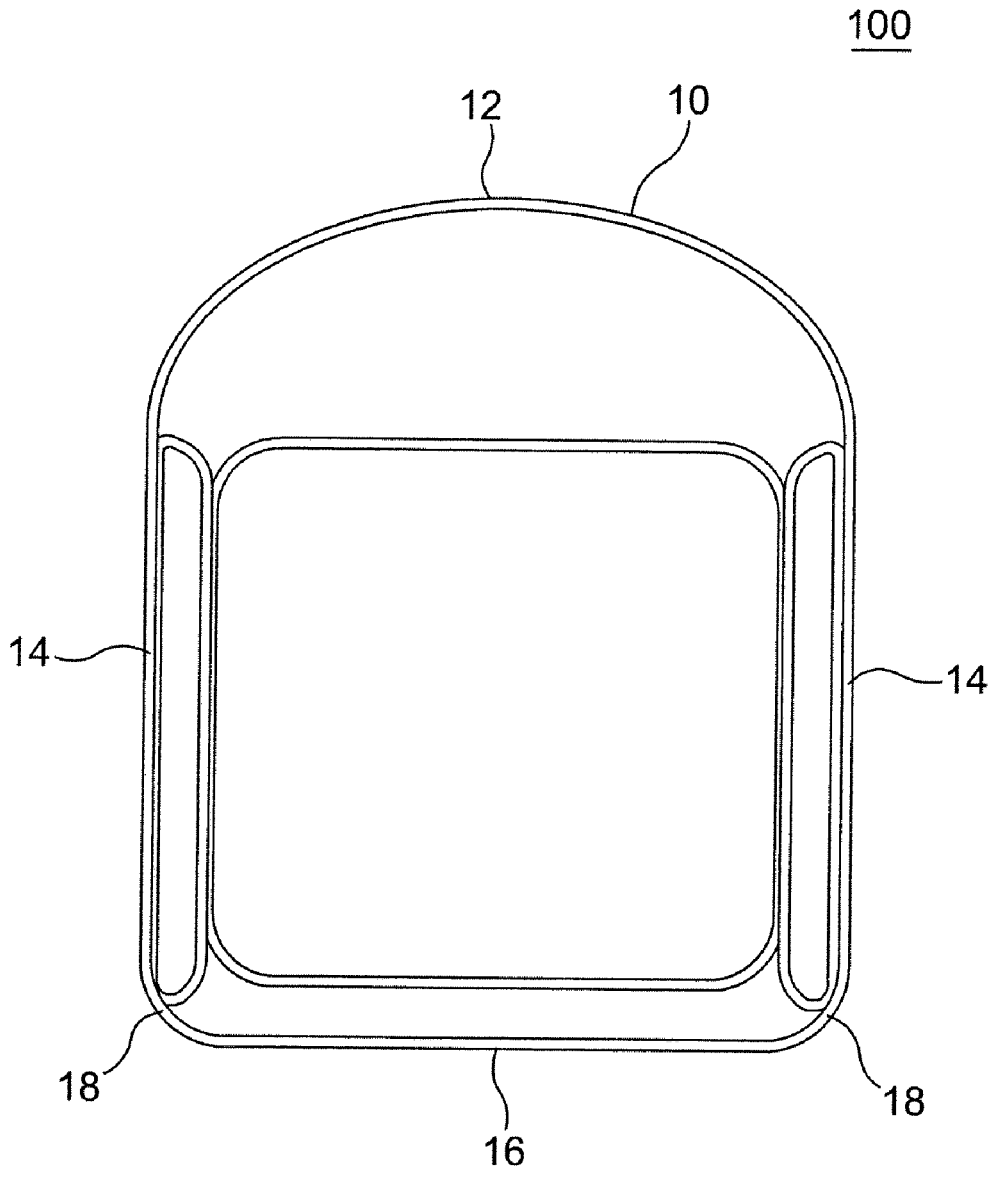
FIG. 2 is a perspective front view of the ball net of FIG. 1.

The front loop 10 comprises a top curved portion 12, two side straight portions 14, a bottom straight portion 16, and two lower corner portions 18 as shown in FIG. 2.

Figure 3:
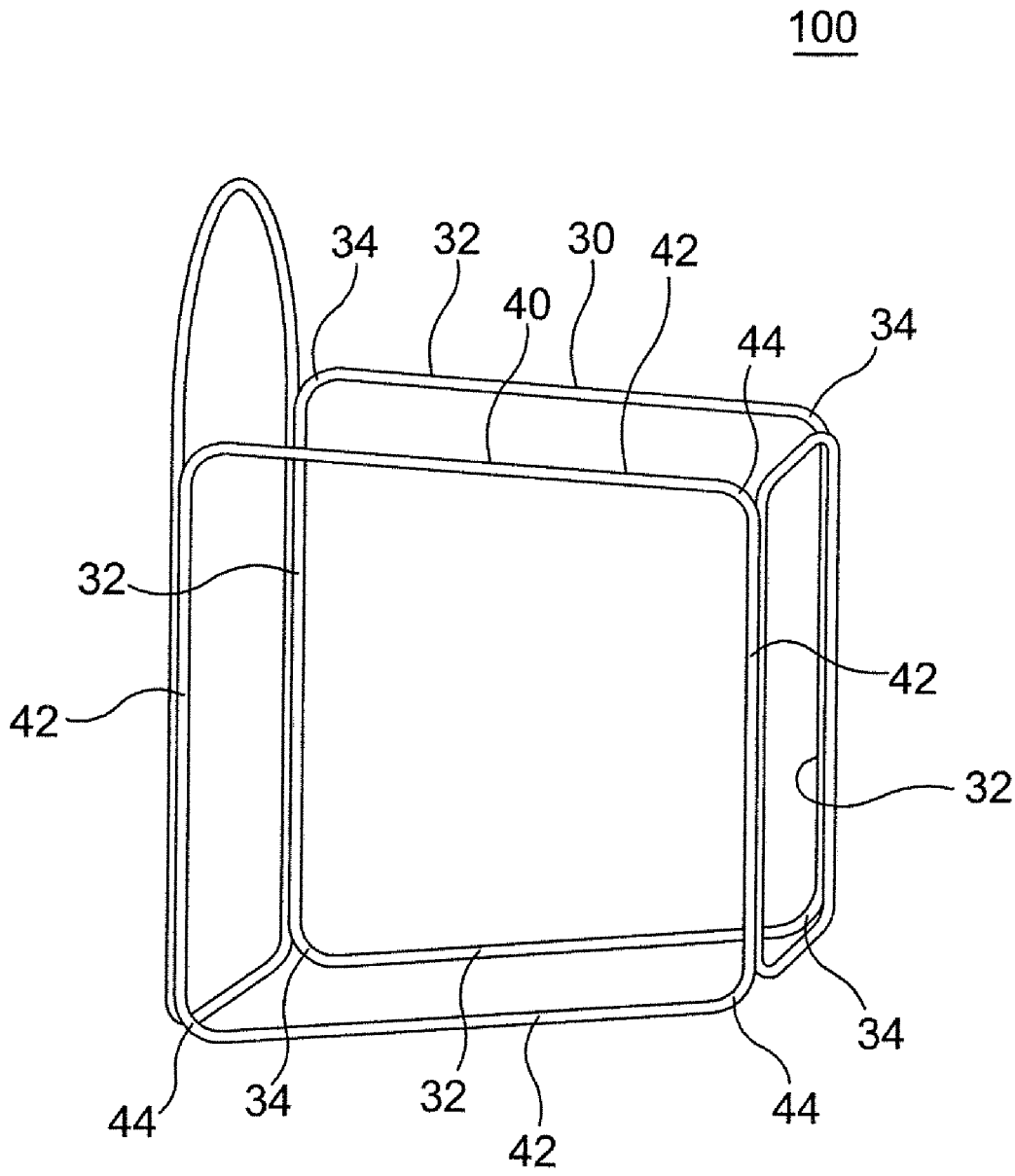
FIG. 3 is a perspective side view of the ball net of FIG. 1.
Figure 4:
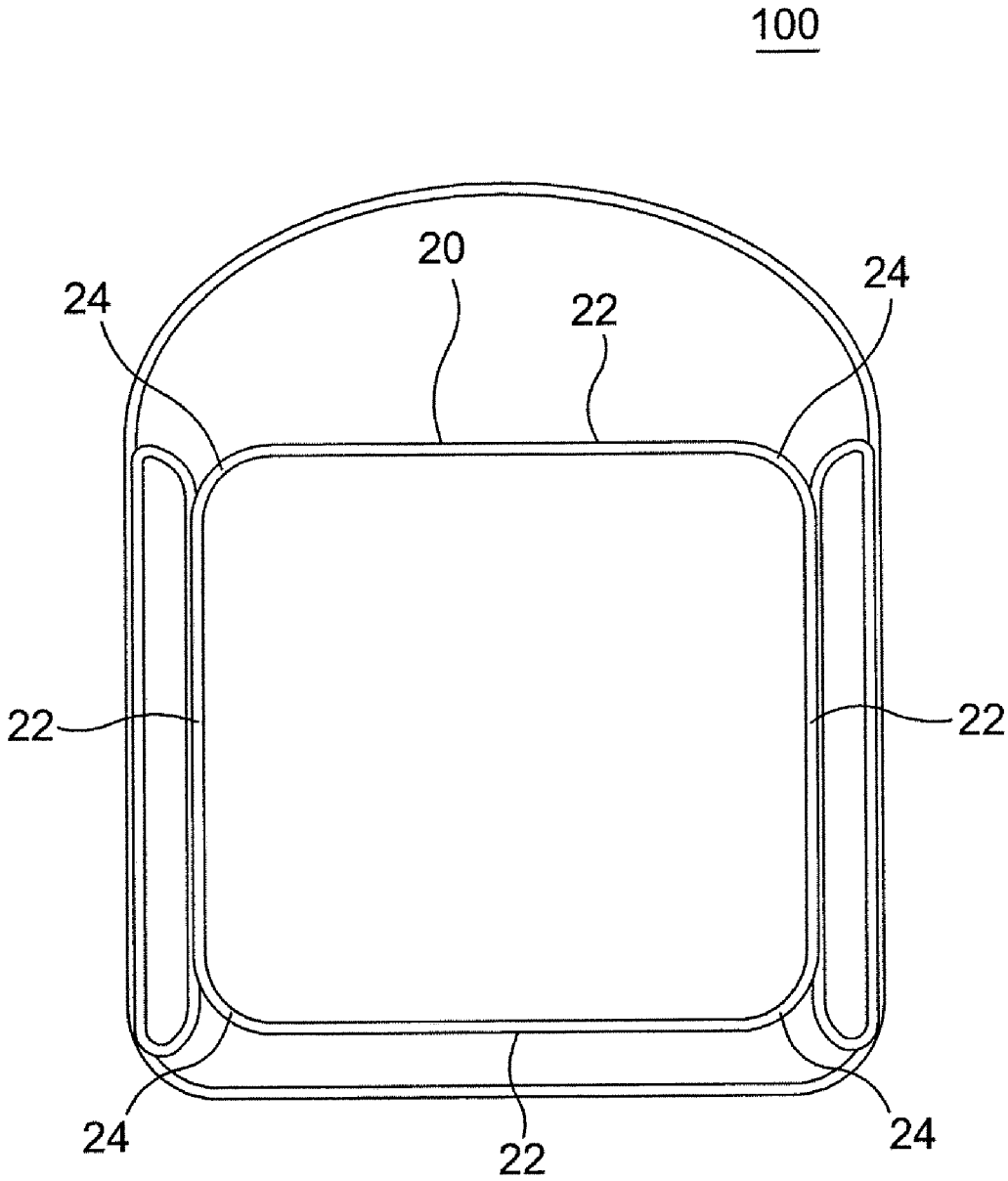
FIG. 4 is a perspective rear view of the ball net of FIG. 1.

The rear loop 20 comprises four straight portions 22 and four corner portions 24 as shown in FIG. 4, and the rear loop 20 is disposed such that a plane defined by the rear loop 20 is substantially parallel to a plane defined by the front loop 10. In certain embodiments of the invention, the planes defined by the front loop 10 and the rear loop 20 may lean toward each other as shown in FIG. 3, which may increase the stability of the ball net 100 against force applied sideways by wind.

Figure 5:
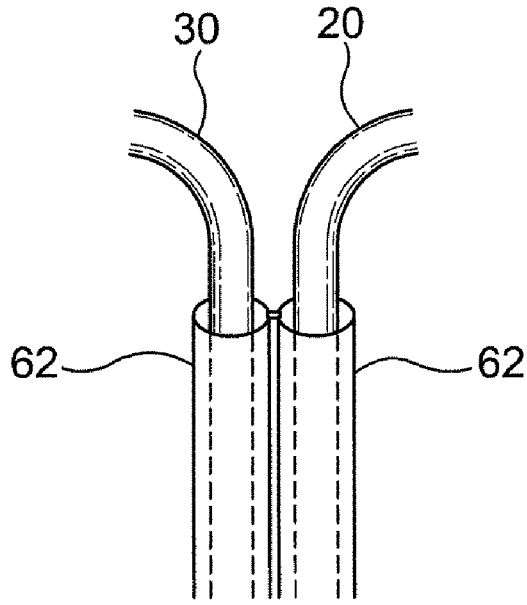
FIG. 5 is a perspective view showing engaging two loops according to an embodiment of the invention.

The first side loop 30 comprises four straight portions 32 and four corner portions 34 as shown in FIG. 3. A side one of the four straight portions 32 engages foldably one of the two side straight portions 14 of the front loop 10, and another side one of the four straight portions 32 engages foldably one of the four straight portions 22 of the rear loop 20. In certain embodiments of the invention, the engaging may be performed by one or more fasteners 62 as shown in FIG. 5. The one or more fasteners 62 may be configured to engage the loops 10, 20, 30, 40 loosely and snugly, allowing the loops to budge at least by a little. In certain embodiments of the invention, the one or more fasteners 62 may be a part of the enclosing net portion 60.

The second side loop 40 comprises four straight portions 42 and four corner portions 44. A side one of the four straight portions 42 engages foldably one of the two side straight portions 14 of the front loop 10, and another side one of the four straight portions 42 engages foldably one of the four straight portions 22 of the rear loop 20, such that the front loop 10, the rear loop 20, the first side loop 30, and the second side loop 40 form a box-type space in the middle. The box-type space 70 is enclosed by the enclosing net portion 60 everywhere export for a front hole defined by the front loop 10.

Figure 6:
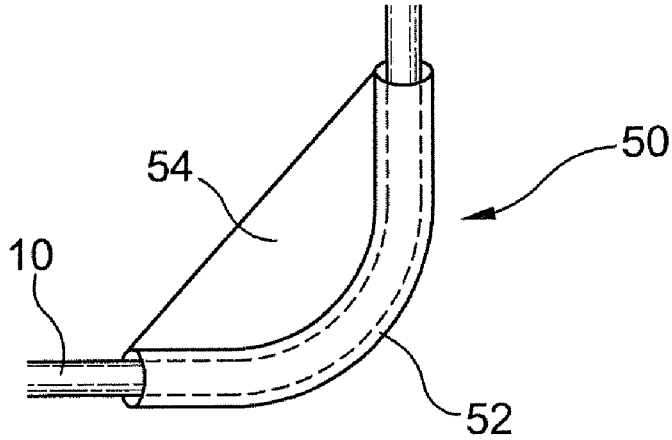
FIG. 6 is a perspective view of a fabric holder portion according to an embodiment of the invention.
Figure 7:
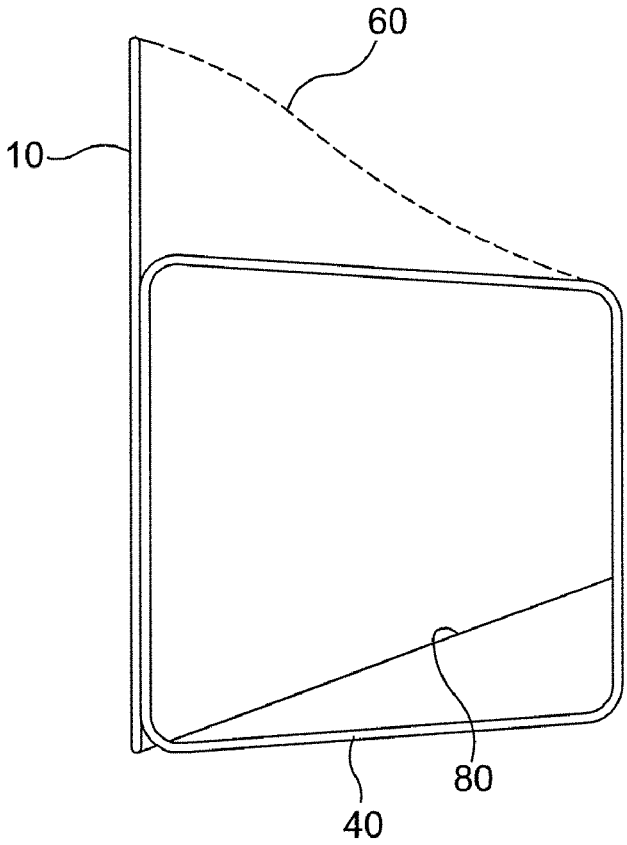
FIG. 7 is a side plan view of the ball net with a titled bottom net portion installed according to an embodiment of the invention.

The plurality of triangular holders 50 are for holding two straight portions 14, 16, 22, 32, 42 having a corner portion 18, 24, 34, 44 inbetween so as to form a substantially right angle between the two straight portions 14, 16, 22, 32, 42 as shown in FIG. 6. The illustrated triangular holder 50 may comprise a tube portion 52 and a holding portion 54 as shown in FIG. 6. The triangular holder 50 may be fabricated with fabric in an embodiment of the invention and engages the enclosing net portion 60.

The enclosing net portion 60 are for covering a top hole formed by top portions 12, 22, 32, 42 of the loops 10, 20, 30, 40, two side holes formed by the side loops 30, 40, and a rear hole formed by the rear loop 20, so as to enclose the box-type space 70 from four sides. In certain embodiment of the invention, the enclosing net portion 60 may cover a bottom hole defined by bottom straight portions 16, 22, 32, 42 of the loops 10, 20, 30, 40.

The vertical side straight portions 14, 22, 32, 42 of neighboring loops 10, 20, 30, 40 are hold together by fabric holder portions 62 as shown in FIG. 5.

The top curved portion 12 of the front loop 10 protrudes above the top straight portions of the other loops 20, 30, 40, such that the front hole or opening defined by the front loop 10 provides a receiving area larger than the other holes defined by the other loops 20, 30, 40 especially in a upper portion of the receiving area as can be seen clearly in FIGS. 3 and 4.

The front loop 10 has a larger area than the other loops 20, 30, 40 in a lower portion of the receiving area.

A width of top portion of the front loop 10 may be smaller than a width of bottom portion of the front loop 10 as shown in FIG. 2.

In FIGS. 2-4, in order to show the loops 10, 20, 30, 40 clearly, the enclosing net portion 60 is not shown. For the same reason, the front loop 10 is depicted thicker than the other loops 20, 30, 40.

Figure 8:
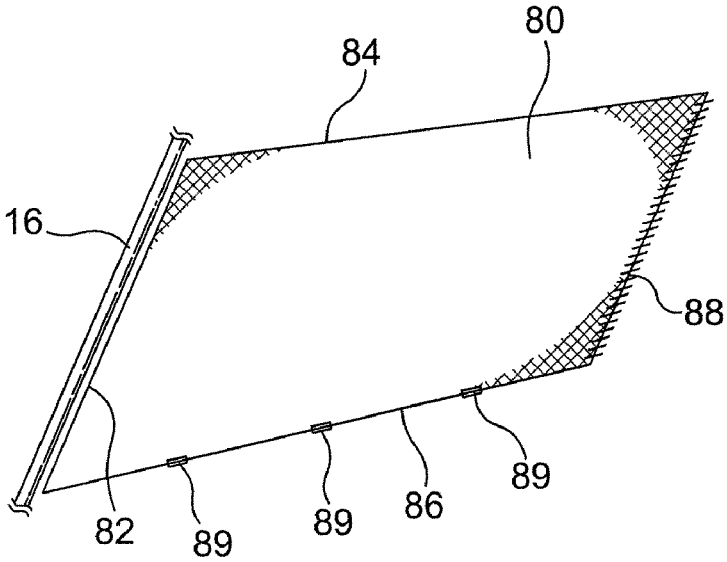
FIG. 8 is a perspective view of a titled bottom net portion.

The ball net 100 may further comprise a tilted bottom net portion 80 having a front edge portion 82, two side edge portions 84, 86, and a rear edge portion 88 as shown in FIG. 8. The front edge portion 82 may engage the bottom straight portion 16 of the front loop 10. The rear edge portion 88 may engage the enclosing net portion 60 for covering the rear hole formed by the rear loop 20 along a line which is horizontal to the straight portion 22 at a bottom and elevated by a predetermined height. One of the two side edge portions 84, 86 may engage the enclosing net portion 60 for covering the side hole, and the other one of the two side edge portions 84, 86 detachably may engage the enclosing net portion 60 for covering the other side hole.

A corner of the front edge portion 82 of the tilted bottom net portion 80 may be fixed to a corner portion extending from the bottom straight portion 16 of the front loop 10. The corner portion may be curved. In certain embodiments of the invention, the corner of the front edge portion 82 of the tilted bottom net portion 80 may be fixed to the lower corner portion 18.

The rear edge portion 88 of the tilted bottom net portion 80 may be fixed to the enclosing net portion 60 covering the rear hole.

The rear edge portion 88 of the tilted bottom net portion 80 may be attached to the enclosing net portion 60 covering the rear hole by sewing or seaming together as shown in FIG. 8.

One of the two side edge portion 84, 86 of the tilted bottom net portion 80 may be fixed to the enclosing net portion 60 covering the side hole corresponding to the side edge portion 84, 86.

One of the two side edge portion 84, 86 of the tilted bottom net portion 80 may be detachably attached to the enclosing net portion 60 covering the side hole corresponding to the side edge portion 86 by one or more fasteners 89.

The one or more fasteners 89 may comprise a plurality of loop and hook fasteners, a plurality of hanging hooks, and a plurality of clips. The one or more fasteners 89 may be fixed to the side edge portion 86.

A corner of the front edge portion 82 of the tilted bottom net portion 80 may be fixed to a lower part of the side straight portion 16 of the front loop 10.

The corners of the rear edge portion 88 of the tilted bottom net portion 80 detachably may engage vertical straight portions 22 of the rear loop 20.

A plurality of portions of the rear edge portion 88 may be fixed to the enclosing net portion by a plurality of fasteners similar to the fasteners 89.

One or more fasteners may comprise a plurality of loop and hook fasteners.

The fabric holder portions 62 may be integrated with the enclosing net portion 60.

The enclosing net portion 60 may engage the front loop 10, the rear loop 20, and first and second loops 30, 40.

The loops 10, 20, 30, 40 may be disposed through holes provided in the enclosing net portion 60.

While the invention has been shown and described with reference to different embodiments thereof, it will be appreciated by those skilled in the art that variations in form, detail, compositions and operation may be made without departing from the spirit and scope of the invention as defined by the accompanying claims.

What is claimed is:

1. A ball net of box type comprising:

a front loop comprising a top curved portion, two side straight portions, a bottom straight portion, and two lower corner portions;

a rear loop comprising four straight portions and four corner portions, wherein the rear loop is disposed such that a plane defined by the rear loop is parallel to a plane defined by the front loop;

a first side loop comprising four straight portions and four corner portions, wherein a side one of the four straight portions engages foldably one of the two side straight portions of the front loop, and wherein another side one of the four straight portions engages foldably one of the four straight portions of the rear loop;

a second side loop comprising four straight portions and four corner portions, wherein a side one of the four straight portions engages foldably one of the two side straight portions of the front loop, and wherein another side one of the four straight portions engages foldably one of the four straight portions of the rear loop, such that the front loop, the rear loop, the first side loop, and the second side loop form a box-type space in the middle;

a plurality of triangular holders for holding two straight portions having a corner portion inbetween so as to form a substantially right angle between the two straight portions; and an enclosing net portion for covering a top hole formed by top portions of the loops, two side holes formed by the side loops, and a rear hole formed by the rear loop, so as to enclose box-type space from four sides, wherein vertical side straight portions of neighboring loops are hold together by fabric holder portions, wherein the top curved portion of the front loop protrudes above the top straight portions of the other loops, such that a front opening defined by the front loop provides a receiving area larger than the other holes defined by the other loops especially in a upper portion of the receiving area, and wherein the front loop has a larger area than the other loops in a lower portion of the receiving area.

2. The ball net of claim 1, wherein a width of top portion of the front loop is smaller than a width of bottom portion of the front loop.

3. The ball net of claim 1, further comprising a tilted bottom net portion having a front edge portion, two side edge portions, and a rear edge portion, wherein the front edge portion engages the bottom straight portion of the front loop, wherein the rear edge portion engages the enclosing net portion for covering the rear hole formed by the rear loop along a line which is horizontal to the straight portion at a bottom and elevated by a predetermined height, wherein one of the two side edge portions engages the enclosing net portion for covering the side hole, and wherein the other one of the two side edge portions detachably engages the enclosing net portion for covering the other side hole.

4. The ball net of claim 3, wherein a corner of the front edge portion of the tilted bottom net portion is fixed to a corner portion extending from the bottom straight portion of the front loop.

5. The ball net of claim 4, wherein the corner portion is curved.

6. The ball net of claim 3, wherein the rear edge portion of the tilted bottom net portion is fixed to the enclosing net portion covering the rear hole.

7. The ball net of claim 6, wherein the rear edge portion of the tilted bottom net portion is attached to the enclosing net portion covering the rear hole by sewing or seaming together.

8. The ball net of claim 6, wherein one of the two side edge portion of the tilted bottom net portion is fixed to the enclosing net portion covering the side hole corresponding to the side edge portion.

9. The ball net of claim 6, wherein one of the two side edge portion of the tilted bottom net portion is detachably attached to the enclosing net portion covering the side hole corresponding to the side edge portion by one or more fasteners.

10. The ball net of claim 9, wherein the one or more fasteners comprise a plurality of loop and hook fasteners, a plurality of hanging hooks, and a plurality of clips.

11. The ball net of claim 3, wherein a corner of the front edge portion of the tilted bottom net portion is fixed to a lower part of the side straight portion of the front loop.

12. The ball net of claim 3, wherein corners of the rear edge portion of the tilted bottom net portion detachably engage vertical straight portions of the rear loop.

13. The ball net of claim 12, wherein a plurality of portions of the rear edge portion are fixed to the enclosing net portion by a plurality of fasteners.

14. The ball net of claim 1, wherein one or more fasteners comprise a plurality of loop and hook fasteners.

15. The ball net of claim 1, wherein the fabric holder portions are integrated with the enclosing net portion.

16. The ball net of claim 1, wherein the enclosing net portion engages the front loop, the rear loop, and first and second loops.

17. The ball net of claim 16, wherein the loops are disposed through holes provided in the enclosing net portion.

* * * * *